US005244049A

United States Patent [19]

Rodert et al.

[11] Patent Number: 5,244,049

[45] Date of Patent: Sep. 14, 1993

[54] ROCK DRILLING DEVICE

[75] Inventors: Jörgen Rodert, Saltsjö-Boo; Kurt Andersson, Tyresö, both of Sweden

[73] Assignee: Uniroc AB, Fagersta, Sweden

[21] Appl. No.: 937,650

[22] Filed: Aug. 31, 1992

[30] Foreign Application Priority Data

Sep. 24, 1991 [SE] Sweden ..... 9102752

[51] Int. Cl.[5] ..... E21B 7/00

[52] U.S. Cl. ..... 175/52; 175/85

[58] Field of Search ..... 175/52, 55, 85, 87, 175/122, 170, 171

[56] References Cited

U.S. PATENT DOCUMENTS 3,420,319 1/1969 Lincoln et al. ..... 175/52
3,741,322 6/1973 Wolters ..... 175/52
3,913,753 10/1975 Swartz et al. ..... 175/52 X
4,765,401 8/1988 Boyadjieff ..... 175/85 X

*Primary Examiner*—Thuy M. Bui
*Attorney, Agent, or Firm*—Eric Y. Munson; Mark P. Stone

[57] ABSTRACT

Rock drilling device comprising a drilling tool with a set of tubes (7) and a set of rods (9) arranged therein. The drilling tool comprises a number of sections which each comprises a tube (7), a rod (9) and an end piece (11). The rod is provided with projections (10) at least near one of its ends for cooperation with parts (13,14) with reduced diameter in the tube and end piece respectively. The part (13) in the tube limits the movement of the rod in a direction away from the end piece. The part (14) in the end piece limits the movement of the rod in a direction towards the end piece. All thread connections (12) between different sections of the drilling tool and between tube and end piece within each section are made in the same way and thus equally easy to break.

4 Claims, 2 Drawing Sheets

ROCK DRILLING DEVICE

The present invention relates to a rock drilling device of the kind where a rock drilling tool comprising a set of tubes for transferring rotation from the rock drilling machine to the drill bit and a set of rods arranged in the set of tubes for transferring impact energy from the rock drilling machine to the drill bit is used.

In a prior art device of the above mentioned kind a drilling tool comprising a number of sections is used, whereby each section comprises two approximatively equally long tubes which are connected by means of a thread connection having cylindrical threads. This thread connection is more difficult to break than those thread connections with conical threads existing between the different sections. Drilling tools of this kind makes it more difficult to inspect and possibly change the rod and/or the guides for the rod because the cylindrical thread connection is more difficult to break.

The present invention, which is defined in the accompanying claims, shows a rock drilling device where the above mentioned drawbacks have been done away with by making all thread connections of the same kind and thus equally easy to break.

Figure 1:
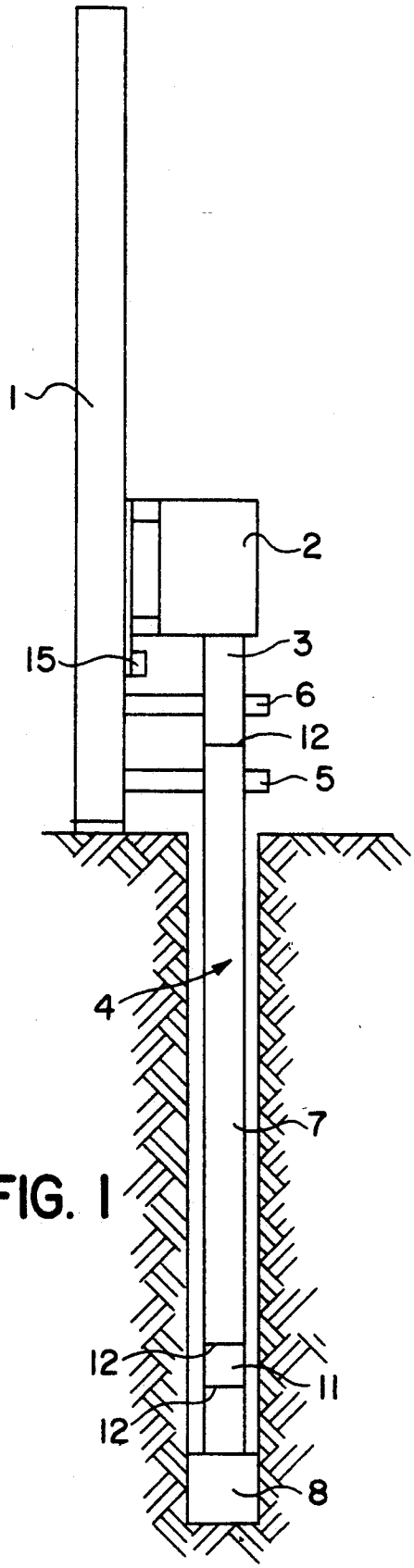
Figure 2:
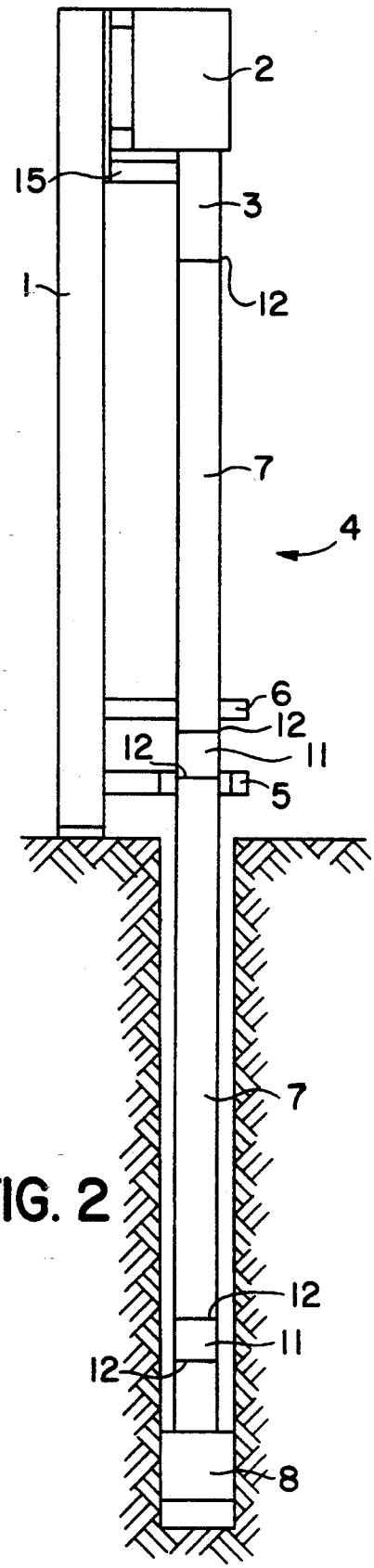
Figure 3:
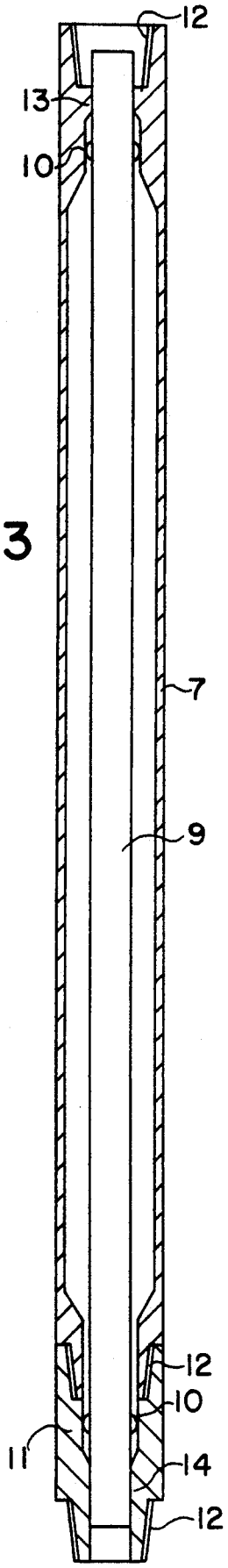
Figure 4:
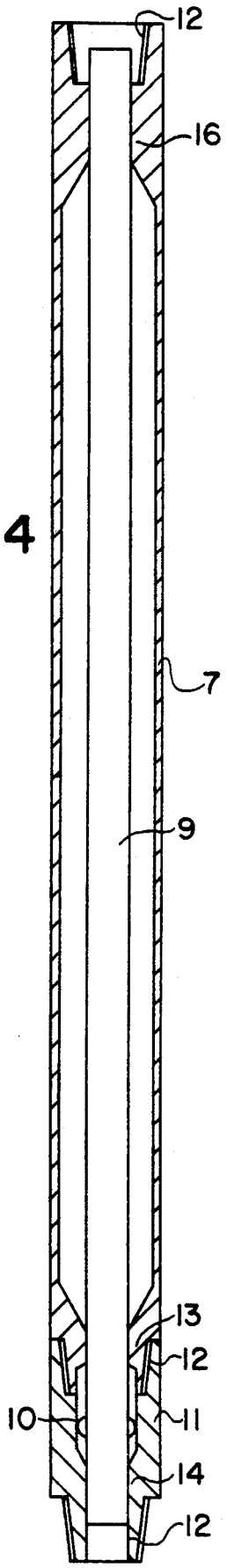

Embodiments of the invention are described below with reference to the accompanying drawings in which FIG. 1 shows a rock drilling device according to the invention where the joint between the shank adapter and the drilling tool is situated in the breaking device. FIG. 2 shows the rock drilling device when the joint between the shank adapter and the drilling tool is situated above the breaking device. FIG. 3 shows a section of the drilling tool where the rod is provided with projections near its both ends. FIG. 4 shows an alternative embodiment where the rod has projections only at one of its ends.

The rock drilling device shown in the drawings comprises a feed beam 1 which is mounted on a not shown carrier in the usual way. A rock drilling machine 2 is movable to-and-fro along the feed beam. The rock drilling machine comprises a shank adapter 3 to which a drilling tool 4 is connected. The drilling tool comprises a number of sections which are screwed together and a drill bit 8. In FIG. 1 a drilling tool with one section is shown and in FIG. 2 with two sections. The drilling tool thus comprises a set of tubes 7 for transferring rotation from the rock drilling machine to the drill bit. Furthermore, the drilling tool comprises a set of rods 9, comprising a number of loosely against each other resting rods, for transferring impact energy from the rock drilling machine to the drill bit. Each section of the drilling tool comprises a tube 7, a rod 9 and an end piece 11. The different sections of the drilling tool are connected by means of thread connections 12, which in the shown examples comprise conical threads. The end piece 11 is connected with tube 7 of the same section by means of a thread connection of the same type as the thread connections between the sections. Tube 7 is provided with a part 13 with reduced diameter for cooperation with projections 10 on rod 9. The part 13 limits the movement of the rod in the direction away from end piece 11. End piece 11 is provided with a part 14 with reduced diameter which cooperates with projections 10 to limit the movement of rod 9 in the direction towards the end piece. In the embodiment according to FIG. 3 rod 9 is provided with projections near both of its ends. In the embodiment according to FIG. 4 the rod has projections only near one of its ends. These parts with reduced diameter function as guides/-bearings for rod 9. In the embodiment according to FIG. 4 tube 7 is also provided with a part 16 for journalling rod 9. In order to be able to break the thread connections after drilling the device is provided with a breaking device in form of two gripping means 5,6. These gripping means comprise hydraulically actuatable jaws by means of which drilling tools and/or shank adapter can be held in a firm grip. Gripping means 6 which is situated nearest to the rock drilling machine is furthermore actuatable by means of a hydraulic cylinder or similar so that the drilling tool can be turned about its longitudinal axis. In order to be able to break the thread connection between drilling tool and shank adapter when the thread connection cannot be placed between gripping means 5,6 the drilling device is provided with a locking device 15 which prevents the shank adapter from turning.

When the depth of the drill hole is approximately equal to a multiple of the length of one section of the drilling tool, i.e. the drilling tool takes after the drilling the position shown in FIG. 1, the thread connection between the drilling tool and the shank adapter is broken by actuating the two gripping means 5,6 so that they grip drilling tool and shank adapter respectively. Then the shank adapter 3 is turned through actuation of gripping means 6. Then the drilling tool can be lifted by the rock drilling machine and the thread connection disconnected completely by the rotation motor of the rock drilling machine. At other hole depth one comes to the situation shown in FIG. 2. The thread connection between drilling tool and shank adapter cannot be placed between gripping means 5,6. In this case the drilling tool is placed such that the lower part of tube 7 can be gripped by gripping means 6 with end piece 11 below gripping means 6. Gripping means 5 is left unactuated so that the drilling tool can rotate in gripping means 5. Locking means 15 is activated so that it prevents the shank adapter from rotating. Then the gripping means 6 is rotated so that the thread connection between the drilling tool and the shank adapter is broken. Then one proceeds as in the case according to FIG. 1.

We claim:

1. Rock drilling device comprising a feed beam (1), a rock drilling machine (2) movable to-and-fro along the feed beam, a drilling tool (4) connected to a shank adapter (3) arranged in the rock drilling machine and a breaking device (5,6) associated with said feed beam for breaking a thread connection (12) between different sections of said drilling tool and/or between said drilling tool and said shank adapter, whereby said drilling tool (4) comprises a set of tubes (7) for transferring rotation from the rock drilling machine to a drill bit (8) connected to the set of tubes and a set of rods (9) arranged in the set of tubes for transferring impact energy from the rock drilling machine to said drill bit, characterized in that each of said sections comprises a tube (7), a rod (9) arranged in said tube and provided with projections (10) at least near one of its ends and an end piece (11), whereby said tube is provided with a thread at each end and a part (13) with reduced diameter for cooperation with said projections to limit the movement of the rod in a direction away from said end piece, the end piece is provided with a thread (12) at each of its ends for cooperation with said tube (7) and another section and the end piece comprises a part (14) with reduced diameter for cooperation with said projections to limit the movement of the rod in a direction towards the end piece and said threads (12) are male and female threads which are made such that any male thread can cooperate with any female thread.

2. Rock drilling device according to claim 1, characterized in that a locking device (15) is arranged to prevent said shank adapter (3) from turning when the thread connection (12) between the drilling tool (4) and the shank adapter is broken by means of said breaking device (5,6).

3. Rock drilling device according to claim 2, characterized in that said breaking device comprises two adjacent to each other arranged gripping means (5,6) for holding said drilling tool (4), whereby the gripping means (6) closest to the rock drilling machine (2) is made such that it can turn the drilling tool about its longitudinal axis.

4. Rock drilling device according to claim 1, characterized in that said breaking device comprises two adjacent to each other arranged gripping means (5,6) for holding said drilling tool (4), whereby the gripping means (6) closest to the rock drilling machine (2) is made such that it can turn the drilling tool about its longitudinal axis.

* * * * *